US008387253B2

(12) United States Patent
Baltes et al.

(10) Patent No.: US 8,387,253 B2
(45) Date of Patent: Mar. 5, 2013

(54) METHOD FOR THE PRODUCTION OF PISTON-TYPE ACCUMULATORS

(75) Inventors: Herbert Baltes, Losheim (DE); Walter Dorr, Völklingen (DE)

(73) Assignee: Hydac Technology GmbH, Sulzbach/Saar (DE)

( * ) Notice: Subject to any disclaimer, the term of this patent is extended or adjusted under 35 U.S.C. 154(b) by 2274 days.

(21) Appl. No.: 10/540,011

(22) Filed: Jun. 22, 2005

(65) Prior Publication Data

US 2006/0016074 A1 Jan. 26, 2006

(30) Foreign Application Priority Data

Feb. 1, 2003 (DE) ..... 103 03 988

(51) Int. Cl.
*B21D 51/16* (2006.01)

(52) U.S. Cl. ..... 29/890.06; 29/509; 29/511; 138/31

(58) Field of Classification Search ..... 138/26, 138/30, 31, 96, 109; 72/239, 369; 29/890.06, 29/509, 511

See application file for complete search history.

(56) References Cited

U.S. PATENT DOCUMENTS

| | | | | |
|---|---|---|---|---|
| 2,734,531 | A * | 2/1956 | Bizak et al. | 138/31 |
| 3,541,833 | A * | 11/1970 | Mercier | 72/355.2 |
| 4,644,976 | A * | 2/1987 | Peter et al. | 138/31 |
| 4,848,448 | A * | 7/1989 | Kaarre | 165/158 |
| 5,115,663 | A * | 5/1992 | Ando et al. | 72/369 |
| 5,311,910 | A * | 5/1994 | Hasegawa et al. | 138/31 |
| 6,460,571 | B1 * | 10/2002 | Rajabi et al. | 138/31 |
| 7,395,838 | B2 | 7/2008 | Weber et al. | |
| 2002/0104433 | A1 | 8/2002 | Colombo | |
| 2004/0238054 | A1 * | 12/2004 | Weber | 138/31 |

FOREIGN PATENT DOCUMENTS

| | | |
|---|---|---|
| DE | 2 238 211 | 2/1974 |
| DE | 42 05 199 C2 | 9/1992 |
| EP | 1 128 073 A1 | 8/2001 |
| JP | 03092679 A * | 4/1991 |

OTHER PUBLICATIONS

Machine Translation of EP 1128073 A1, Audureau, Aug. 2001.*

* cited by examiner

*Primary Examiner* — David Bryant
*Assistant Examiner* — Ryan J Walters
(74) *Attorney, Agent, or Firm* — Roylance, Abrams, Berdo & Goodman L.L.P.

(57) ABSTRACT

A method produces piston-type accumulators, including an accumulator housing (10) and a separating piston, which can be displaced in a longitudinal direction inside the accumulator housing (10) and separates two working spaces located in the housing. One end face of the accumulator housing is sealed by cover part (20). The cover part (20) is fixed on one side (40) via the free longitudinal edge (32) of the accumulator housing (10). The edge is displaced towards the cover part (20), such that a functionally and positionally secure connection of a cover part is ensured within the housing of a piston-type accumulator without using standard threaded connections.

19 Claims, 4 Drawing Sheets

Fig.1 Stand der Technik (Prior Art)

METHOD FOR THE PRODUCTION OF PISTON-TYPE ACCUMULATORS

FIELD OF THE INVENTION

The present invention relates to a method for the production of piston-type accumulators having an accumulator housing and a separating piston displaceable in the longitudinal direction in the accumulator housing and separating two working chambers from each other. The accumulator housing is sealed on each of the end sides by a cover component.

BACKGROUND OF THE INVENTION

Piston-type accumulators are, in the broadest sense of the term, hydraulic accumulators, which among other things serve the purpose of receiving specific volumes of a pressurized liquid (hydraulic medium) of a hydraulic system and returning these volumes to the system when required. Since the hydraulic medium is pressurized, hydraulic accumulators are treated as pressure reservoirs and must be designed for the maximum excess operating pressure, the acceptance standards of various installing countries being taken into consideration. Hydropneumatic (gas-charged) accumulators with a separating element are currently used in most hydraulic systems. A piston separates a fluid space as working chamber from a gas space as additional working chamber, serving as separating element inside the accumulator housing of the piston-type accumulator. Nitrogen is generally used as the operating gas. The gas-tight piston to a great extent permits disconnection of the gas space from the fluid space.

The fluid component is connected to the hydraulic circuit so that, as the pressure rises, the piston-type accumulator admits or receives fluid and the gas is compressed in the process. As the pressure drops, the compressed gas expands and displaces the pressurized fluid back into the hydraulic circuit. One advantage of piston-type accumulators is they can "work" when in any position, but preference is given to vertical positioning with the gas side on top, so that settling of fouling particles from the fluid on the piston seals is prevented.

Consequently, the essential components of a piston-type accumulator are an outer cylindrical tube forming the accumulator housing, the piston forming the separating element with its sealing system, and the sealing covers on the housing ends. The cover elements also contain a fluid connection and a gas connection. Two functions are regularly assigned to the accumulator housing, specifically storage of internal pressure and ensuring control of the piston inside the accumulator housing. The cover components on the front surface sealing the interior of the accumulator housing off from the exterior are provided on the outer circumference with external threading which may be screwed into a corresponding inner threading along the free longitudinal edge over an assigned path. Production of the respective threaded connection is time-consuming; and correspondingly increases the production costs of the piston-type accumulator. In addition, safety measures must be taken to secure the cover component in its position.

SUMMARY OF THE INVENTION

An object of the present invention is to provide an improved manufacturing process for piston-type accumulators where a reliable operation of a cover component secured in position in the accumulator housing is guaranteed, and where the otherwise customary threaded connections are avoided.

This object is basically attained by a method or process in which the cover component on one of its sides is fastened by the free longitudinal edge of the accumulator housing, which housing edge is for this purpose moved onto the cover component. The otherwise customary screw connection is avoided for the cover component. A clamping onto the free end of the accumulator housing is achieved in which the cover component is clamped at least over the free longitudinal edge of the accumulator housing after this housing has been moved onto the cover component. It is sufficient if a part of the free longitudinal edge effects this clamping.

In one preferred embodiment of the method of the present invention, at least one of the two cover components is inserted until one cover side engages a stop in the interior of the accumulator housing such that the respective cover component is retained in its end position by the clamping force of the longitudinal edge introduced. If a stop is provided on the inside of the accumulator housing, the cover component may be immobilized against this stop during the positioning movement of the free longitudinal edge of the accumulator housing. In addition or as an alternative, however, the possibility exists of inserting the cover component into the free end of the accumulator housing and then initiating the positioning movement of the free end of the accumulator housing. The positioning movement may be effected toward the upper or outer side of the cover if the cover component is retained in a suitable position. An unrestrained positioning movement may also be effected for the longitudinal edge and then, in the state of readiness for operation, the cover component may be moved by the piston against the free longitudinal edge, which then effects the clamping there.

Preferably, a shaping tool is provided for the positioning movement of the longitudinal edge of the accumulator housing. The tool is provided with positioning bevels and positions the longitudinal edge of the accumulator housing on the cover component in such a way that this cover component is secured in the accumulator housing as the clamping seat.

In one especially preferred embodiment of the method of the present invention, two shaping tools positioned on opposite sides carry out the fastening process for the respective end cover component in a common positioning movement to the accumulator housing. These shaping tools act on the free longitudinal edge of the accumulator housing. It has been found to be highly advantageous for the purpose of generation of high fastening forces to position the two free ends of the cylindrical accumulator housing uniformly. The shaping tool which acts on one end of the accumulator housing is capable in addition of reliably withstanding the forces introduced onto the accumulator housing by the other shaping tool.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
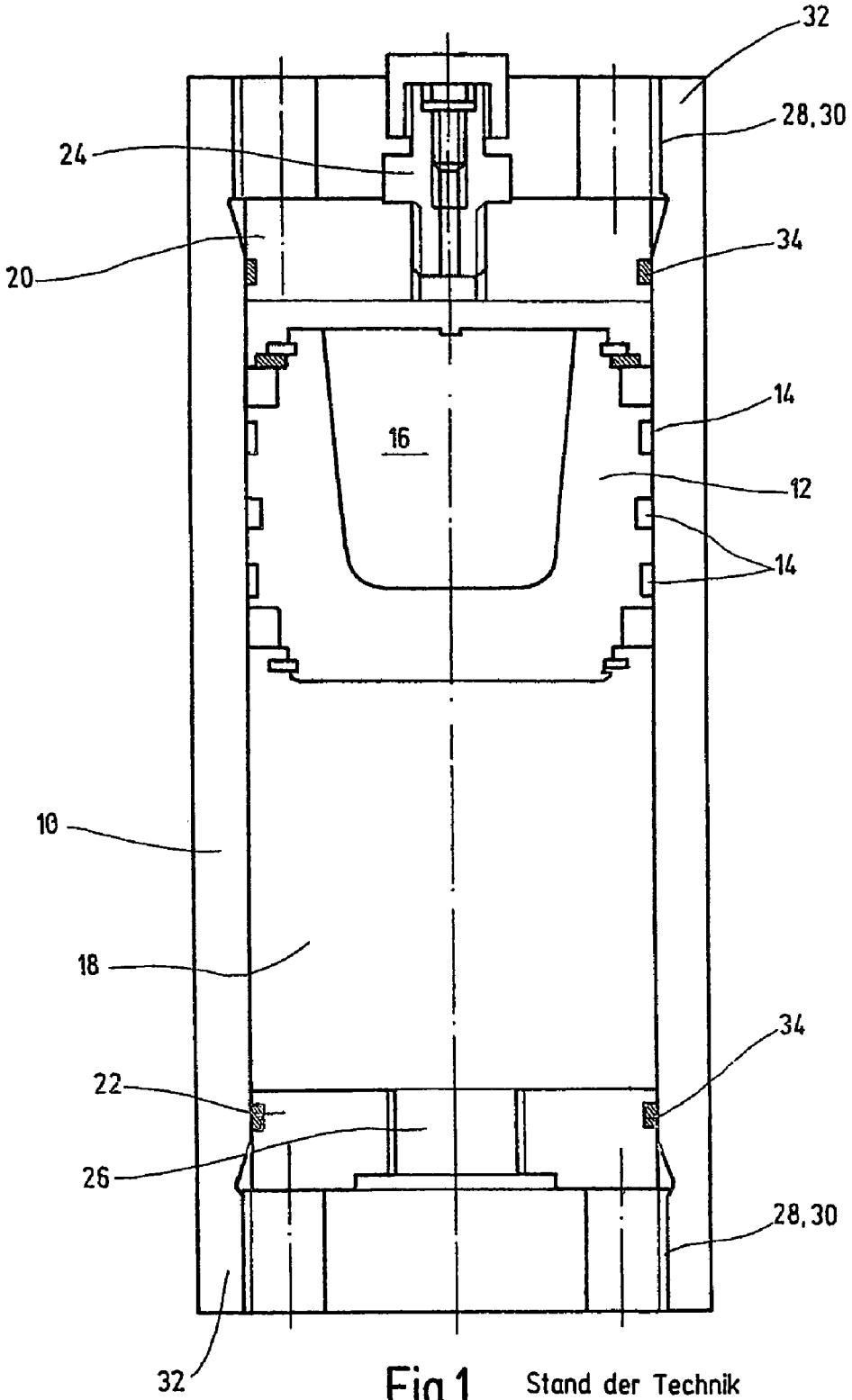
FIG. 1 is a side elevational view in section of a conventional piston-type accumulator.

The conventional piston-type accumulator shown in FIG. 1 has an accumulator housing 10 in the form of an outer cylindrical tube. A piston 12 with its sealing system 14 on the piston exterior is introduced as separating element so as to be longitudinally displaceable in the housing. Inside the accumulator housing 10, the piston 12 separates two working chambers 16, 18 from each other, one working chamber 16 serving to receive an operating gas, in particular one in the form of nitrogen, while the other working chamber 18 forms the fluid space for the piston-type accumulator. The displaced position of the piston 12 and accordingly the volume percentages of gas and fluid in the working chambers 16 and 18 vary with the operating situation of the accumulator. A cover component 20, 22 is mounted on each end of the accumulator housing 10 having a gas connection 24 for recharging with nitrogen operating gas and a fluid connection 26 for connecting the piston-type accumulator to an overall hydraulic system (not shown), respectively.

Each of the two cover components 20, 22 is provided with external threading 28 which may be engaged with internal threading 30 extending along the free longitudinal edge 32 and outward to the exterior. On the external circumference side, each cover component 20, 22 is provided with a seal 34 for sealing the interior of the accumulator housing 10 from the exterior. Application of the lengths of threading 28, 30 entails a certain production effort making the prior piston-type accumulators complex and expensive to produce. It is also necessary to secure each cover component 20, 22 from rotation to ensure its fixing in position inside the accumulator housing 10. One possible method of securing the respective cover component 20, 22 from rotation involves providing a conventional adhesive seal along the threading 28, 30, or by keeping the cover component in its position by a conventional retention bore (with and without threading).

Figure 2:
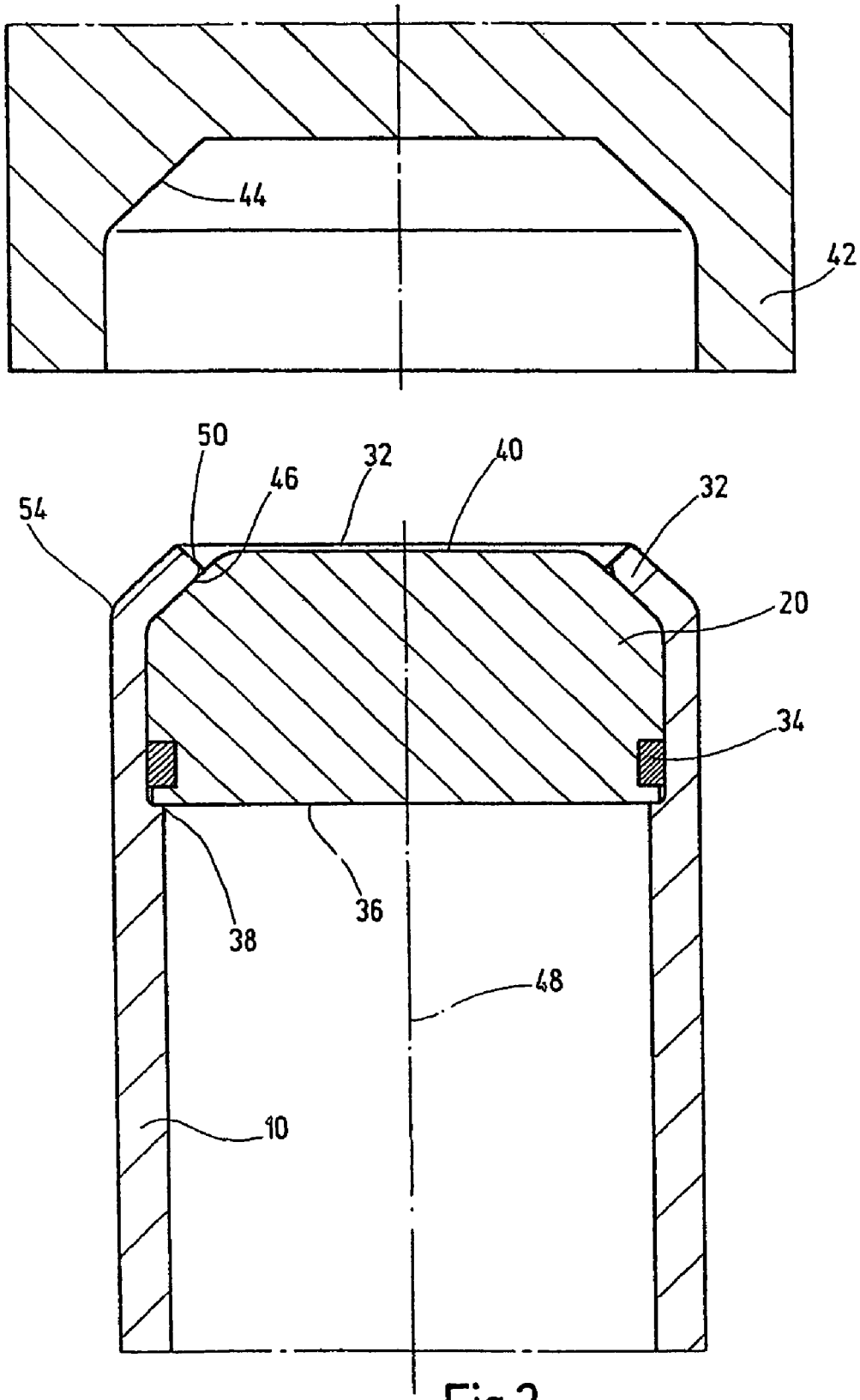
FIG. 2 is a side elevational view in section of the upper part of a piston-type accumulator with a shaping tool positioned above it, according to a first embodiment of the present invention.

Based on this prior art, the method of the present invention will now be described in greater detail with reference to FIGS. 2-7. This solution permits cost-effective creation of a reliably operating connection of cover component and the associated accumulator housing 20. For the sake of greater simplicity of presentation, only the upper end of the accumulator housing 10 is shown in FIG. 2, along with the upper cover component 20. When reference is made to these structural components below, as with the prior art embodiment shown in FIG. 1, the respective structural components are designated by the same reference numbers as in FIG. 1.

The method of the present invention is among other things characterized in that the respective cover component, in this instance cover component 20, is inserted by its lower or inner side 36 to come into contact with a stop or shoulder 38 in the form of an annular surface in the interior of the accumulator housing 10. The cover component is secured on its opposite side 40 by the free longitudinal edge 32 of the accumulator housing 10. The longitudinal edge 32 undergoes a positioning movement relative to the cover component 20, as is to be explained in greater detail in what follows.

An axially movable shaping tool 42 serves to position the longitudinal edge 32 of the accumulator housing 10. This shaping tool 42 is provided with at least one positioning bevel 44 which positions the longitudinal edge 32 onto the cover component 10 so that this cover component is secured as a clamping seat in the accumulator housing 10 between the stop 38 and the longitudinal edge 32. For the purpose of establishing the respective clamping seat, the upper or outer side 40 of the cover component 20 is provided with a circumferential contact surface 46 tapering toward the longitudinal axis 48 of the accumulator housing 10 in the outward direction of the cover component. The inclination of the contact surface 46 corresponds to the inclination of the positioning bevel 44 of the shaping tool 42. However, other obvious inclinations or bevels are also conceivable. As is shown in FIG. 2, the positioning direction for the shaping tool 42 is that of the longitudinal axis 48 of the accumulator housing 10 or of the piston-type accumulator as a whole.

For the sake of greater clarity of illustration, the separating element in the form of the piston 12 is omitted from FIG. 2, as are the gas connection 24 shown in FIG. 1, which is also an integral part of the upper cover component 20. Before the clamp connection is effected by the shaping tool 42, the upper free end of the accumulator housing with its upper longitudinal edge 32 has an outline as shown in FIGS. 3 to 6. The wall thickness of the longitudinal edge 32 is reduced in comparison to the rest of the accumulator housing 10. The area of transition between the different wall thicknesses forms the stop 38 for the cover component 20. In addition, the longitudinal edge 32 is provided with a tapering insertion bevel 50, by preference on its side facing the cover component 20. The bevel is oriented outward. The respective insertion bevel 50 facilitates introduction of the cover component 20 into the free upper end of the accumulator housing 10, as will be described in greater detail below. Cover component 10 is inserted into the housing until its inner surface 36 engages stop 38 to prevent further insertion.

Figures 3, 4, 5, 6:
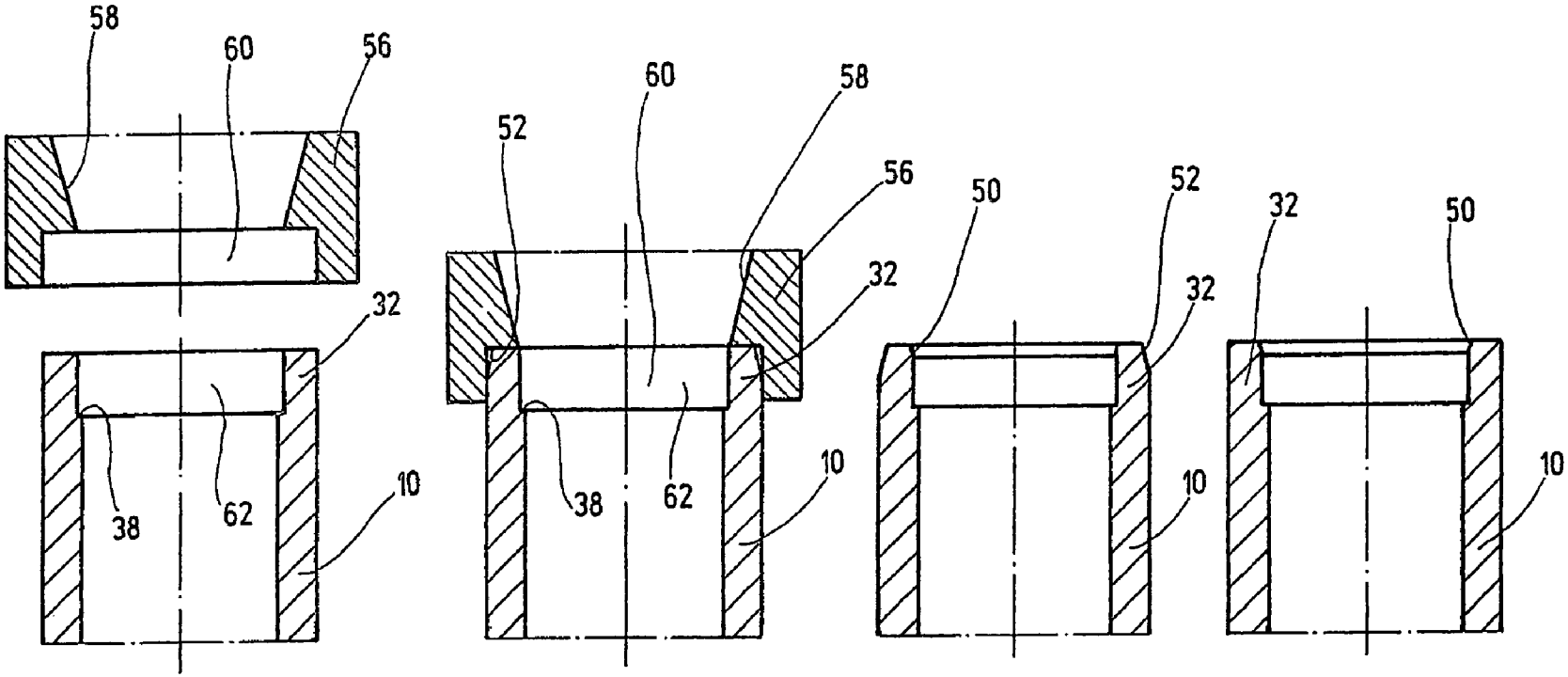
FIGS. 3 and 4 are side elevational views in section of the positioning of a positioning tool on the free end of the accumulator housing for the purpose of fastening the respective cover component, according to a second embodiment of the present invention.
FIGS. 5 and 6 are side elevational views in section of the upper areas of the accumulator housing in the form of two different versions with insertion bevels positioned in the interior for introduction of the respective cover component, according to third and fourth embodiments of the present invention, respectively.

As is shown in FIGS. 4 and 5 in particular, the free longitudinal edge 32 may also be provided on the external circumference side with a slide bevel 52 oriented toward the free end of the accumulator housing 10. This slide bevel makes it easier for the longitudinal edge 32 to effect transition from its cylindrical shape as shown in FIGS. 3 to 6 to an inclined position after being positioned. The slide bevel 52 slides along the positioning bevel 44 of the shaping tool 42 until the shaping tool is visibly mounted on the accumulator housing 10 in the direction of positioning. Once the axial positioning movement by the shaping tool 42 has been completed, the longitudinal edge 32 is inclined along the contact surface 46 of the cover component 20 to form a fastening bevel. In this way, the cover component 20 is secured against the stop 38 inside the accumulator housing 10.

To avoid endangering the secure position of the cover component 20 in the accumulator housing 10 and also to protect the cover component 20 from introduction of harmful forces, the free longitudinal edge 32 is, as shown in FIG. 2, guided along its free end so as to project over the second side 40 of the cover component 20. After the clamp connection has been secured, the shaping tool 42 is moved back away from the accumulator housing 10 and then, for example, assumes its upper position as illustrated in FIG. 2. By preference the shaping process for the respective longitudinal edge 32 of the accumulator housing 10 is effected as cold forming, but hot forming involving appropriate heating of the accumulator housing material and preferably the shaping tool 42 as well is also conceivable. A conventional easily shaped steel material is used for the accumulator housing 10 with its longitudinal edge 32. To introduce the clamping forces optimally into the cover component 20 and also to ensure optimal support for the cover component 20 in the accumulator housing 10, the edge side is made such that the height of the cover component 20 is adapted to the application conditions assigned by operation of the accumulator. In the case illustrated, the cover component 20 is at least twice as great as the length of the longitudinal edge 32 between its free end and a deflection point 54 from which the longitudinal edge 32 is moved onto the top of the cover.

Specifically, the method for producing a piston accumulator involves mounting a piston in an accumulator housing 10 for movement along a longitudinal axis 48 of the housing 10 with the piston separating an interior of the housing into two working chambers between first and second longitudinal ends of the housing. A first shoulder 38 in the interior of the housing 10 is provided adjacent to but spaced from the first longitudinal end 32 of the housing 10 to form a first end portion of the housing with a reduced wall thickness relative to an adjacent portion of the housing, with a transition part between different wall thicknesses forming the first shoulder 38. A first cover component 20 is inserted at least partially within the housing 10 through the first longitudinal end when open until an inner surface portion of the first cover component engages the first shoulder 38 preventing further insertion of the first cover component. The first end portion of the housing is deformed to form a bend 54 between the first shoulder and the first longitudinal end through an acute angle relative to the longitudinal axis against an axially facing outer circumferential contact surface 46 extending at a corresponding acute angle relative to the longitudinal axis and about an axially facing outer surface portion 40 of the first cover component radially within the outer circumferential contact surface to secure the first cover component in the housing with the first cover component sealing the first longitudinal end of the housing closed by moving a first shaping tool 42 only axially along the longitudinal axis, the first shaping tool being unitary without any relatively movable parts. The second longitudinal end of the housing is sealed closed in the same manner.

As shown in FIG. 2, each end portion of the housing extending directly from the respective longitudinal end is deformed to form an obtuse angle with an axially aligned section of the housing between deflection point or bend 54 and the respective shoulder or stop 38.

Figure 7:
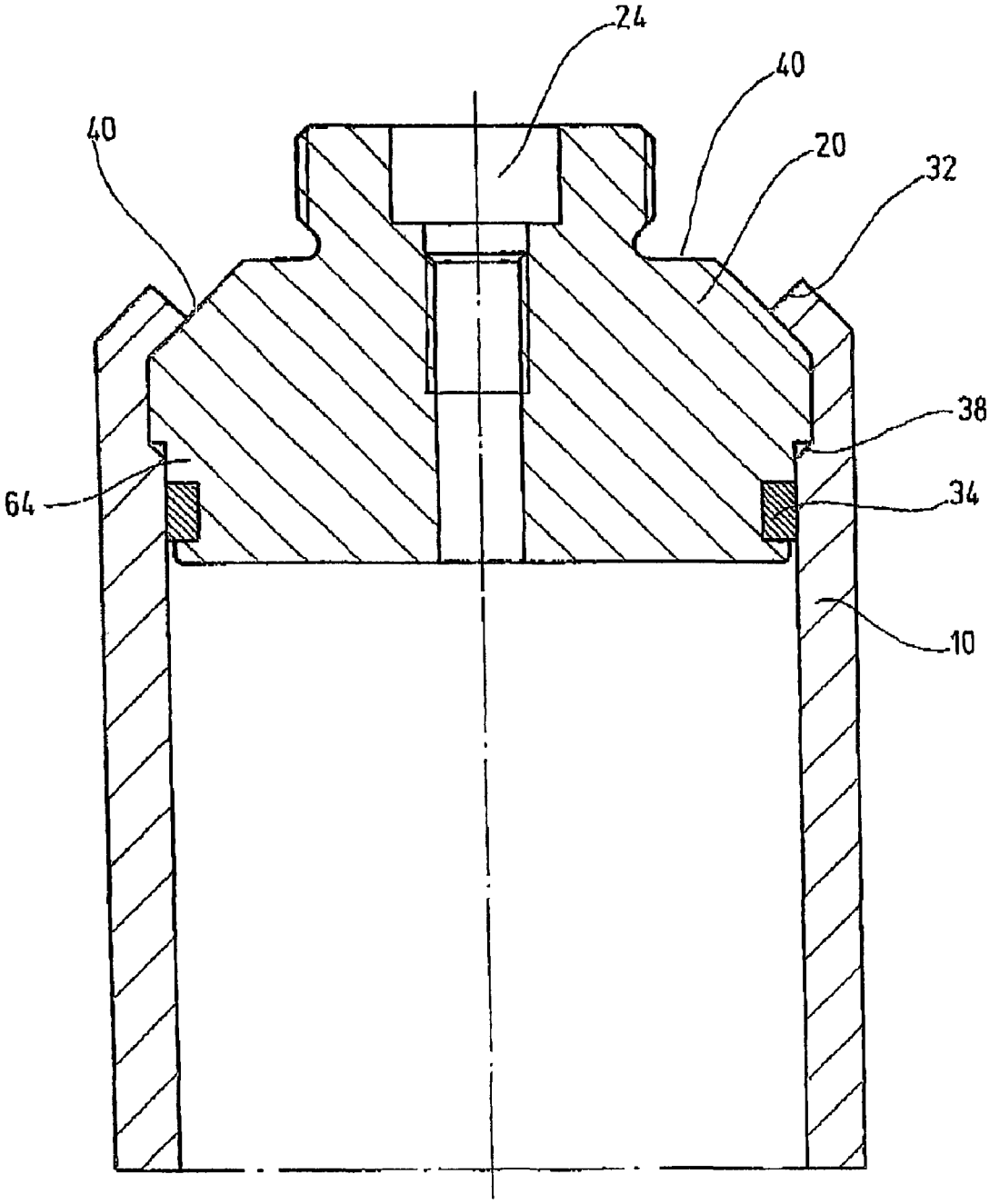
FIG. 7 is a side elevational view in section of the upper part of a piston-type accumulator housing with modified cover component, according to a fifth embodiment of the present invention.

As is illustrated in FIG. 7 for a modified embodiment, the cover component 20 may nevertheless project beyond the longitudinal edge 32 of the accumulator housing 10, or, in another embodiment not shown, may end so as to be flush at the same level.

In one especially preferred embodiment (not shown) of the method of the present invention, the fastening process for the end cover components 20, 22 is carried out in a common axial positioning movement of two shaping tools 42 on opposite ends of the accumulator housing 10 simultaneously with more or less equal shaping forces acting on the free longitudinal edges 32 of the accumulator housing 10. In such shaping method, each shaping tool can, during shaping, receive the forces of the other shaping tool such as occur during the forming process. Costly support devices may be dispensed with in this configuration on the respective opposite sides where the shaping tool 42 exerts no effect. Harmonious introduction of forces into the accumulator housing 10 without the occurrence of damaging power peaks also occur in this situation.

As is shown in FIGS. 3 and 4, the respective cover component 20, 22 may be introduced into the accumulator housing 10 up to the stop 38 in the form of an annular surface by a positioning tool 56. As shown in FIG. 4, positioning tool 56 encloses the free longitudinal edge 32 of the accumulator housing 10. The positioning tool 56 has for the introduction process, a feed bevel 58 along which the cover component 20 or 22 may slide on its external circumference side. Use of the positioning tool 56 reliably prevents possible damage to the seal 34 of the cover component 20 or 22. In addition to the feed bevel 58, the positioning tool 56 has an admission space 60 into which the upper end of the accumulator housing 10 may be introduced so that the feed bevel 58 ends flush with the upper edge of the longitudinal edge, and in addition effects uninterrupted transition to the admission area 62 for the cover component 20, 22 in the accumulator housing 10.

In the embodiments shown in FIGS. 5 and 6, the accumulator housing 10 is provided on the inner circumference side along its upper longitudinal edge 32 with an insertion bevel 50 extending outwardly in the direction of the length of the accumulator housing 10. This bevel results in a slip edge over which the respective cover component 20, 22 may also be introduced and later secured. This alternative may be selected if the cover seal 34 is rugged and not overly susceptible to damage.

The same reference numbers are used for the same structural parts illustrated in FIG. 7. The method employed is described only to the extent that it differs significantly from the method described in the foregoing. In the embodiment shown, the upper cover component 20 is retained by the free longitudinal edge 32 of the accumulator housing 10 so that the upper side projects a predetermined distance beyond the end of the free longitudinal edge 32. In the embodiment shown in FIG. 7, the stop 38 for the cover component 20 is provided with a bevel against which the cover component 20 leans in a stepped recess. The annular seal 34 is in turn received in the outer circumference of the recessed sectional step 64. Because of the stepped arrangement illustrated for accumulator housing 10 and cover component 20, the possibility exists of machining the accumulator housing 10 as finely as possible for clean contact with the sealing ring 34 at this point and of leaving the inside of the accumulator housing 10 more or less unmachined, insofar as the delivery area for the free longitudinal edges 32 of the accumulator housing 10 is affected.

The cover components 20, 22 may accordingly be fastened with high fitting accuracy, reliably, and pressure-tightly in the accumulator housings 10 by the shaping process discussed, in the widest possible variety of embodiments. Screw connections that are cost-intensive in mounting, in addition remain to be secured in this position, and may be dispensed with in their entirety.

While various embodiments have been chosen to illustrate the invention, it will be understood by those skilled in the art that various changes and modifications can be made therein without departing from the scope of the invention as defined in the appended claims.

What is claimed is:

1. A method for producing a piston accumulator, comprising the steps of:

mounting a piston in an accumulator housing for movement along a longitudinal axis of the housing with the piston separating an interior of the housing into two working chambers between first and second longitudinal ends of the housing;

providing at least a first shoulder in the interior of the housing adjacent to but spaced from the first longitudinal end of the housing to form a first end portion of the housing with a reduced wall thickness relative to an adjacent portion of the housing, with a transition part between different wall thicknesses forming the first shoulder;

inserting a first cover component at least partially within the housing through the first longitudinal end when open until an inner surface portion of the first cover component engages the first shoulder preventing further insertion of the first cover component;

deforming the first end portion of the housing to form a bend between the first shoulder and the first longitudinal end through an acute angle relative to the longitudinal axis against an axially facing outer circumferential contact surface of the first cover component extending at a corresponding acute angle relative to the longitudinal axis and about an axially facing outer surface portion of the first cover component radially within the outer circumferential contact surface to secure the first cover component in the housing with the first cover component sealing the first longitudinal end of the housing closed by moving a first shaping tool only axially along the longitudinal axis, the first shaping tool being unitary without any relatively movable parts; and sealing the second longitudinal end of the housing closed.

2. A method according to claim 1 wherein the first longitudinal end has an end edge deformed to be substantially flush with the outer surface portion.

3. A method according to claim 1 wherein a projection extends axially from the outer surface portion of the first cover component.

4. A method according to claim 1 wherein the first cover component tapers in an outward direction along the contact surface.

5. A method according to claim 1 wherein the first end portion is deformed by axially forcing the first shaping tool against and over the first longitudinal end with a positioning bevel in the first shaping tool engaging the first end portion and extending at an acute angle corresponding to the angle of the contact surface.

6. A method according to claim 5 wherein the second longitudinal end is sealed by providing a second shoulder in the interior of the housing adjacent to but spaced from the second longitudinal end of the housing to form a second end portion of the housing with a reduced wall thickness relative to an adjacent portion of the housing, with a transition point between different wall thicknesses forming the second shoulder;

inserting a second cover component at least partially within the housing through the second longitudinal end when open until an inner surface portion of the second cover component engages the second shoulder preventing further insertion of the second cover component; and deforming the second end portion of the housing to form a bend between the second shoulder and the second longitudinal end through an acute angle relative to the longitudinal axis against an axially facing outer circumferential contact surface of the second cover component extending at a corresponding acute angle relative to the longitudinal axis and about an axially facing outer surface portion of the second cover component radially within the outer circumferential contact surface of the second cover component to secure the second cover component in the housing with the second cover component sealing the second longitudinal end of the housing closed by moving a second shaping tool only axially along the longitudinal axis, the second shaping tool being unitary without any relatively movable parts.

7. A method according to claim 6 wherein the second end portion is deformed by axially forcing the second shaping tool against and over the second longitudinal end with a positioning bevel in the second shaping tool engaging the second end portion and extending at an acute angle corresponding to the angle of the contact surface of the second cover component.

8. A method according to claim 7 wherein the deforming of the first and second end portions is performed simultaneously by applying forces in opposite axial directions.

9. A method according to claim 1 wherein the first cover component is guided into the housing by engaging an insertion bevel tapering inwardly from a free end edge of the first longitudinal end on an interior surface of the housing.

10. A method according to claim 1 wherein the second longitudinal end is sealed by providing a second shoulder in the interior of the housing adjacent to but spaced from the second longitudinal end of the housing to form a second end portion of the housing with a reduced wall thickness relative to an adjacent portion of the housing, with a transition point between different wall thicknesses forming the second shoulder;

inserting a second cover component at least partially within the housing through the second longitudinal end when open until an inner surface portion of the second cover component engages the second shoulder preventing further insertion of the second cover component; and deforming the second end portion of the housing to form a bend between the second shoulder and the second longitudinal end through an acute angle relative to the longitudinal axis against an axially facing outer circumferential contact surface of the second cover component extending at a corresponding acute angle relative to the longitudinal axis and about an axially facing outer surface portion of the second cover component radially within the outer circumferential contact surface of the second cover component to secure the second cover component in the housing with the second cover component sealing the second longitudinal end of the housing closed by moving a second shaping tool only axially along the longitudinal axis, the second shaping tool being unitary without any relatively movable parts.

11. A method according to claim 10 wherein the deforming of the first and second end portions is performed simultaneously by applying forces in opposite axial directions.

12. A method according to claim 10 wherein each of the cover components has a height at least twice a height of a deformed section of the respective end portion overlying the respective contact surface.

13. A method according to claim 10 wherein each end portion is deformed to form at an obtuse angle with an axially aligned section of the housing between the respective bend and the respective shoulder.

14. A method according to claim 1 wherein the first cover component is inserted into the housing by a feed bevel of a positioning tool enclosing a free end edge of the first end portion of the housing.

15. A method according to claim 1 wherein an inner circumference of a free end edge of the first longitudinal end comprises an insertion bevel widening toward an exterior of the housing to guide the first cover component into the housing.

16. A method according to claim 1 wherein the first cover component has a height at least twice a height of a deformed section of the first end portion overlying the contact surface.

17. A method according to claim 1 wherein the first end portion is deformed to form an obtuse angle with an axially aligned section of the housing between the bend and the first shoulder.

18. A method according to claim 17 wherein the end portion extends directly from the first longitudinal end.

19. A method according to claim 17 wherein each end portion extends directly from the respective longitudinal end.

* * * * *